US009637284B2

(12) United States Patent
Maple et al.

(10) Patent No.: US 9,637,284 B2
(45) Date of Patent: May 2, 2017

(54) LIQUID DISPENSING LID

(71) Applicants: Wade Maple, Spokane, WA (US); Jeff Steininger, S. Mary's, OH (US)

(72) Inventors: Wade Maple, Spokane, WA (US); Jeff Steininger, S. Mary's, OH (US)

(73) Assignee: Zak Designs, Inc., Spokane, WA (US)

( * ) Notice: Subject to any disclaimer, the term of this patent is extended or adjusted under 35 U.S.C. 154(b) by 293 days.

(21) Appl. No.: 14/626,644

(22) Filed: Feb. 19, 2015

(65) Prior Publication Data

US 2016/0244217 A1 Aug. 25, 2016

(51) Int. Cl.

| | |
|---|---|
| ***B65D 51/18*** | (2006.01) |
| ***B65D 47/32*** | (2006.01) |
| ***B65D 43/02*** | (2006.01) |
| ***B65D 47/20*** | (2006.01) |
| ***B65D 47/28*** | (2006.01) |

(52) U.S. Cl.

CPC ..... *B65D 47/32* (2013.01); *B65D 43/0231* (2013.01); *B65D 47/2018* (2013.01); *B65D 47/286* (2013.01); *B65D 2543/00046* (2013.01); *B65D 2543/00092* (2013.01); *B65D 2543/00231* (2013.01); *B65D 2543/00518* (2013.01); *B65D 2543/00537* (2013.01); *B65D 2543/00555* (2013.01)

(58) Field of Classification Search

CPC .... B65D 47/32; B65D 47/20; B65D 47/2018; B65D 47/28; B65D 47/286; B65D 43/0231

USPC ..... 220/253, 254.1, 254.2, 254.9

See application file for complete search history.

(56) References Cited

U.S. PATENT DOCUMENTS

| | | | | |
|---|---|---|---|---|
| 6,752,287 | B1 * | 6/2004 | Lin | A47G 19/2272 220/254.9 |
| 7,455,191 | B2 * | 11/2008 | Bhavnani | A47J 41/0016 220/254.9 |
| 7,591,389 | B2 * | 9/2009 | Wong | B65D 47/286 220/254.9 |
| 2006/0261068 | A1 * | 11/2006 | Schmidtner | B65D 43/0208 220/254.9 |
| 2007/0278228 | A1 * | 12/2007 | Wong | B65D 47/286 220/254.9 |
| 2008/0073343 | A1 * | 3/2008 | Shadrach | B65D 47/286 220/212 |

* cited by examiner

*Primary Examiner* — Steven A. Reynolds
*Assistant Examiner* — Javier A Pagan
(74) *Attorney, Agent, or Firm* — Randall Danskin P.S.

(57) ABSTRACT

A liquid dispensing lid is described and which includes a lid body which cooperates with a fluid dispensing vessel, and where the lid body defines a drinking aperture; an elongated fluid dispensing member movably cooperates with the upper surface of the lid body so as to selectively occlude the drinking aperture; and an elastomeric biasing member biasingly couples the elongated fluid dispending member to the lid body and further biasingly urges the elongated fluid dispensing member into an orientation where the elongated fluid dispensing member occludes the drinking aperture.

15 Claims, 12 Drawing Sheets

LIQUID DISPENSING LID

TECHNICAL FIELD

The present invention relates to a liquid dispensing lid for a drinking container, and more specifically to a liquid dispensing lid which, on the one hand, reliably regulates the dispensing of a liquid from the internal cavity of a drinking container, and further can be readily disassembled for cleaning and the like.

BACKGROUND OF THE INVENTION

Those skilled in the art will recognize that various liquid dispensing containers have been fabricated and sold over many decades. For many years, these liquid dispensing containers have been designed to meet the needs of the users during various activities. For example, liquid dispensing containers have been specifically designed for assorted events such as running, bicycle riding, hiking, driving an automobile, attendance at sports events and the like. Much attention has been directed in these prior art designs to providing a liquid dispensing vessel which permits a user to consume or dispense liquid from the container in a reliable manner during the activity, and which further prevents accidental spilling of the liquid from the container in the event that the drinking vessel is accidentally overturned.

With regard to drinking containers which are going to be utilized during an athletic event, much attention has been directed towards developing beverage containers which can be operated by a single hand, and which further simultaneously allows for the equalization of air pressure within the internal cavity of the drinking vessel as the beverage contained within the vessel is consumed.

While many possible designs have been developed to address these needs, several shortcomings have become apparent after prolonged usage of these prior art products.

For example, many users of these prior art drinking vessels often use the vessels, overtime, to dispense various beverages such as coffee, soft drinks, water, alcoholic beverages, and the like. These assorted liquids often leave trace amounts of residue on any exposed portion of the fluid dispensing vessel. If these trace residues are not substantially removed, often a sticky residue will buildup, and which will encourage the growth of microorganisms or which further inhibits the proper operation of any sealing device or other assembly employed to selectively dispense the liquid or beverage from the fluid dispensing container.

While these prior art devices have worked with varying degrees of success, the experience of users has been that without periodic proper cleaning of these prior art devices a malfunction will often occur within short order. Further, the prior art devices, and other assemblies utilized, heretofore, have sometimes been complex in their overall design and consequently are often costly to fabricate.

A liquid dispensing lid which avoids the detriments associated with the prior art products, and practices, utilized heretofore is the subject matter of the present invention.

SUMMARY OF THE INVENTION

A first aspect of the present invention relates to a liquid dispensing lid which includes a lid body having an upper and lower surface, and a peripheral edge, and wherein the lid body is sized so as to releasably cooperate with a fluid dispensing vessel having an internal cavity, and wherein the lid body further defines a drinking aperture; an elongated, fluid dispensing member which moveably cooperates with the upper surface of the lid body so as to selectively occlude the drinking aperture; and an elastomeric biasing member which biasingly couples the elongated, fluid dispensing member to the lid body, and which further biasingly urges the elongated, fluid dispensing member into an orientation where the elongated, fluid dispensing member occludes the drinking aperture.

Still another aspect of the present invention relates to a liquid dispensing lid which includes a lid body having an upper and lower surface, and a peripheral edge, and wherein the lid body is sized so as to releasably cooperate with a fluid dispensing vessel having an internal cavity, and wherein the lid body further defines a drinking aperture, and a vent aperture, which individually communicate with the internal cavity of the fluid dispensing vessel; an elongated fluid dispensing member which reciprocally moves along a path of travel relative to the upper surface of the lid body so as to selectively occlude the drinking and vent apertures; a drinking aperture sealing member borne by the elongated fluid dispensing member and which selectively cooperates with the drinking aperture; a vent sealing member borne by the elongated fluid dispensing member, and which selectively cooperates with the vent aperture; and an elastomeric biasing member which is borne by the elongated fluid dispensing member, and which is further coupled to the lid body, and wherein the elastomeric biasing member biasingly urges the elongated fluid dispensing member to move along the path of travel in a given direction so as to occlude the drinking and vent apertures, respectively.

Still another aspect of the present invention relates to a liquid dispensing lid which includes a lid body having an upper and lower surface, and a peripheral edge, and wherein the lid body is sized so as to releasably cooperate with a fluid dispensing vessel having an internal cavity, and wherein the lid body further defines a drinking aperture, a vent aperture and an elastomeric biasing aperture which each communicate with the internal cavity of the fluid dispensing vessel, and wherein a cavity is defined by the upper surface of the lid body, and wherein the lid body is generally circular in shape, and the cavity formed in the upper surface of the lid body extends, generally radially inwardly relative to the peripheral edge of the lid body, and wherein the cavity is defined, at least in part, by a bottom surface, and wherein the vent aperture, drinking aperture, and the elastomeric biasing aperture are formed in the bottom surface of the cavity, and wherein a discontinuous, upwardly extending lid body wall is made integral with peripheral edge of the lid body, and further defines a passageway which communicates with the cavity which is formed in the upper surface of the lid body; an elongated fluid dispensing member which reciprocally moves along a path of travel relative to the upper surface of the lid body so as to selectively occlude the drinking and vent apertures, and wherein the elongated fluid dispensing member is sized so as to be matingly received in the cavity which is defined by the upper surface of the lid body, and wherein the elongated, fluid dispensing member has a main body with a first and second end, top and bottom surfaces, and a recessed region which is formed in the top surface thereof, and wherein the recessed region is located near the second end of the main body, and further has a given shape, and wherein an elastomeric engagement member is sized so as to be matingly received within the recessed region, and positioned in a substantially co-planar relationship relative to the upper surface of the lid body, and wherein the recessed region further has formed therein first, second and third apertures which extend through the elongated, fluid dispensing member, and wherein the elongated, fluid dispensing member further has a downwardly depending cam follower which is made integral with the bottom surface of the elongated, fluid dispensing member, and which further has a peripheral edge which moveably cooperates with the upper surface of the lid body, and which is located within the cavity, and wherein the reciprocal movable cooperation of the elongated fluid dispensing member relative to the lid body is effective in urging the downwardly depending cam follower to reciprocally move along a portion of the upper surface of the lid body, and effect a corresponding reciprocal movement of the elongated, fluid dispensing member along the path of travel from a first, occluding position relative the drinking and vent apertures, respectively, to a second non-occluding position relative thereto; a drinking aperture sealing member which is made integral with the elastomeric engagement member, and which further depends downwardly from the elongated fluid dispensing member, and selectively cooperates with the drinking aperture; a vent sealing member which is made integral with the elastomeric engagement member, and which further depends downwardly from the elongated fluid dispensing member, and selectively cooperates with the vent aperture, and wherein the drinking aperture sealing member, and the vent aperture sealing member are both sized so as to individually pass through the first and second apertures, respectively, and which are formed in the elongated fluid dispensing member; and an elastomeric biasing member is made integral with the elastomeric engagement member, and which further depends downwardly from the elongated fluid dispensing member, and wherein the biasing member is further coupled to the lid body, and wherein the elastomeric biasing member biasingly urges the elongated fluid dispensing member to move along the path of travel in a given direction so as to occlude the drinking and vent apertures, respectively, and wherein the biasing member is located in spaced relation relative to the drinking and vent aperture sealing members, and further has a main body which passes through the third aperture which is formed in the elongated fluid dispensing member, and wherein the biasing member has a first end which cooperates with the elongated, fluid dispensing member, and an opposite, second end which passes through the elastomeric biasing aperture, and wherein a portion of the biasing member matingly cooperates with the lower surface of the lid body, and wherein the first end of the biasing member is forcibly retained in cooperation with the elongated, fluid dispensing member by the elastomeric engagement member, and wherein the movable cooperation of the elongated fluid dispensing member relative to the lid body is effective in urging the downwardly depending cam follower to reciprocally move along the upper surface of the lid body, and effect a corresponding movement of the elongated, fluid dispensing member along the path of travel from the first position, and wherein the respective drinking aperture sealing member, and vent aperture sealing member are located in an occluding position relative to the drinking aperture, and vent apertures, respectively, to a second position, and where the drinking aperture sealing, and vent sealing members are located in a non-occluding position relative to the drinking and vent apertures, respectively, and wherein the elastomeric biasing member biasingly elongates when the elongated fluid dispensing member moves from the first to the second position, and wherein the elongated biasing member forcibly returns the elongated, fluid dispensing member from the second position to the first position and along the path of travel.

These and other aspects of the present invention will be discussed in greater detail hereinafter.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

Figure 1:
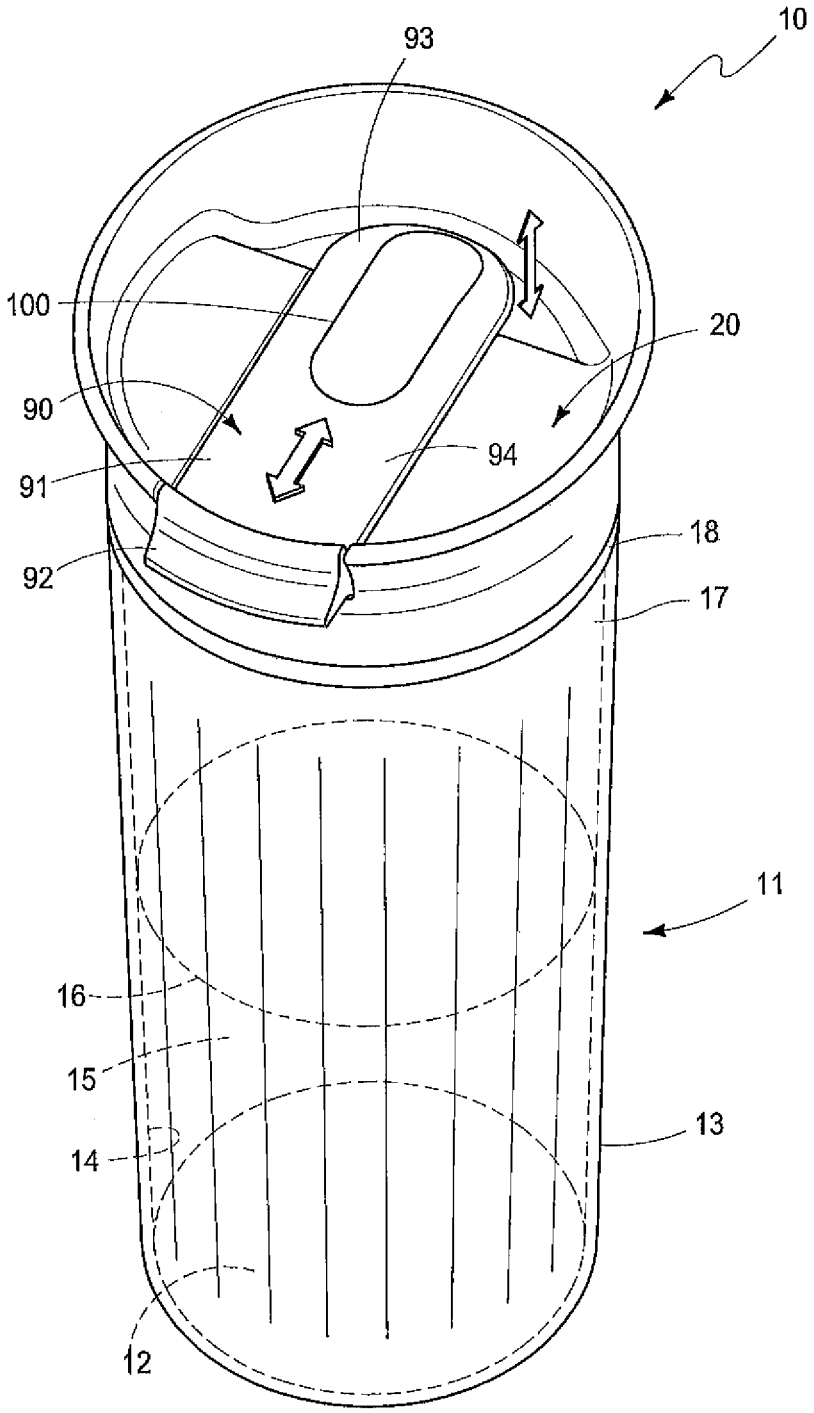
FIG. 1 is a perspective view of the liquid dispensing lid of the present invention, and which is shown in a conventional environment.
Figure 2:
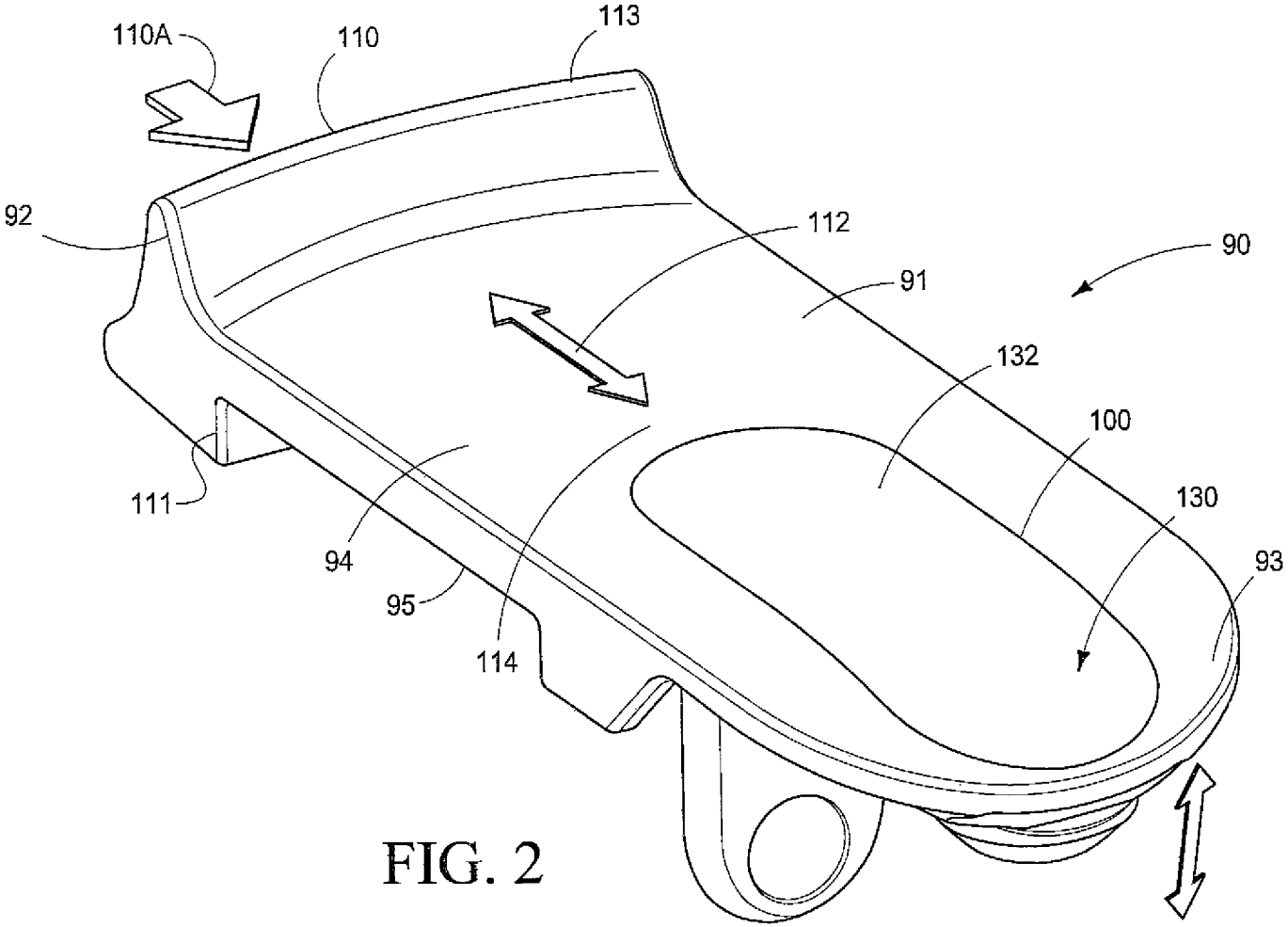
FIG. 2 is a greatly enlarged, fragmentary, perspective view of an elongated fluid dispensing member, and which forms a feature of the present invention.
Figure 3:
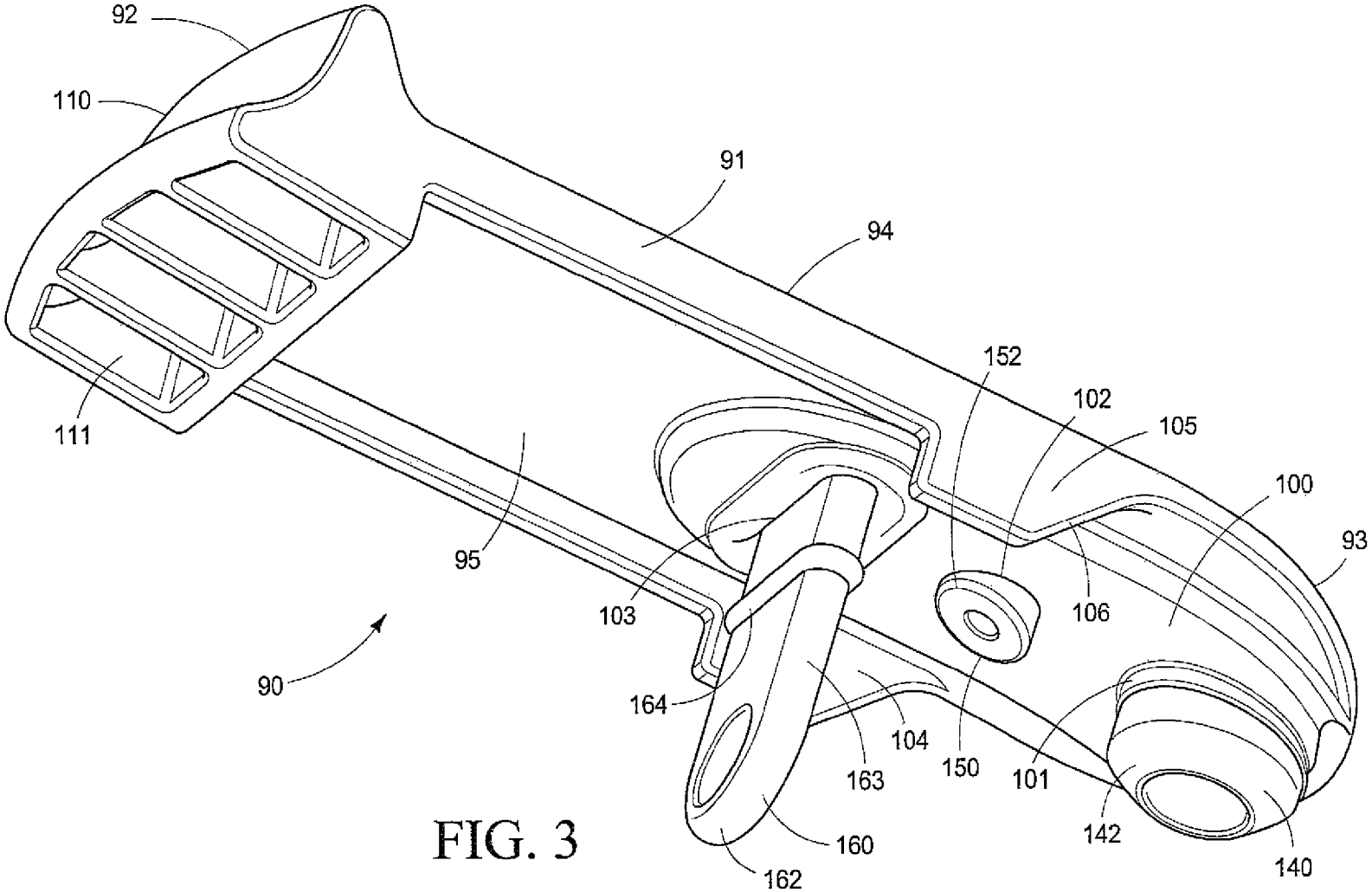
FIG. 3 is a greatly enlarged, perspective, bottom view of the elongated fluid dispensing member as seen in FIG. 2.
Figure 4:
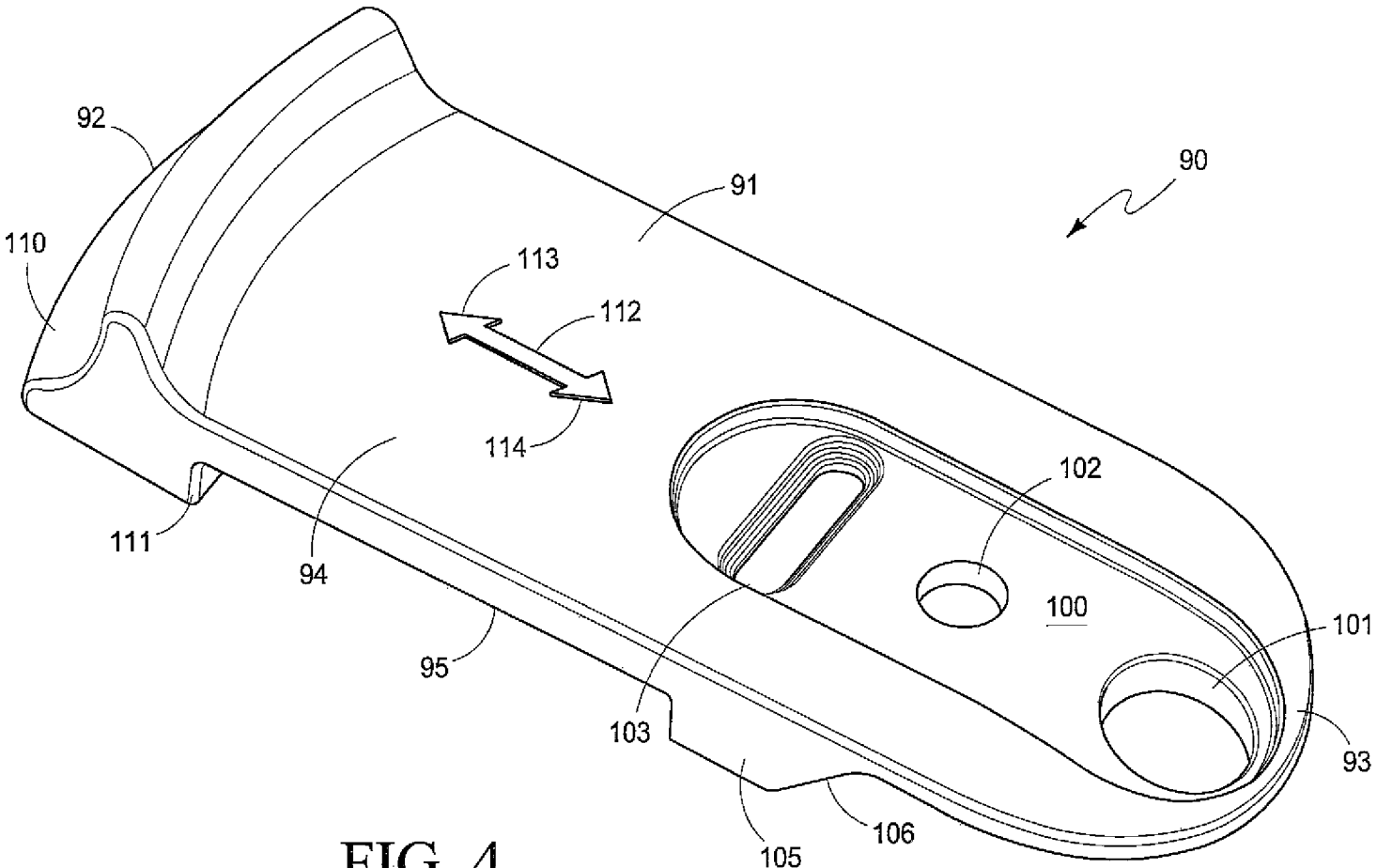
FIG. 4 is a greatly enlarged, fragmentary, plan view of the liquid dispensing member which forms a feature of the present invention and which further illustrates the liquid dispensing member without an elastomeric engagement member.
Figure 5:
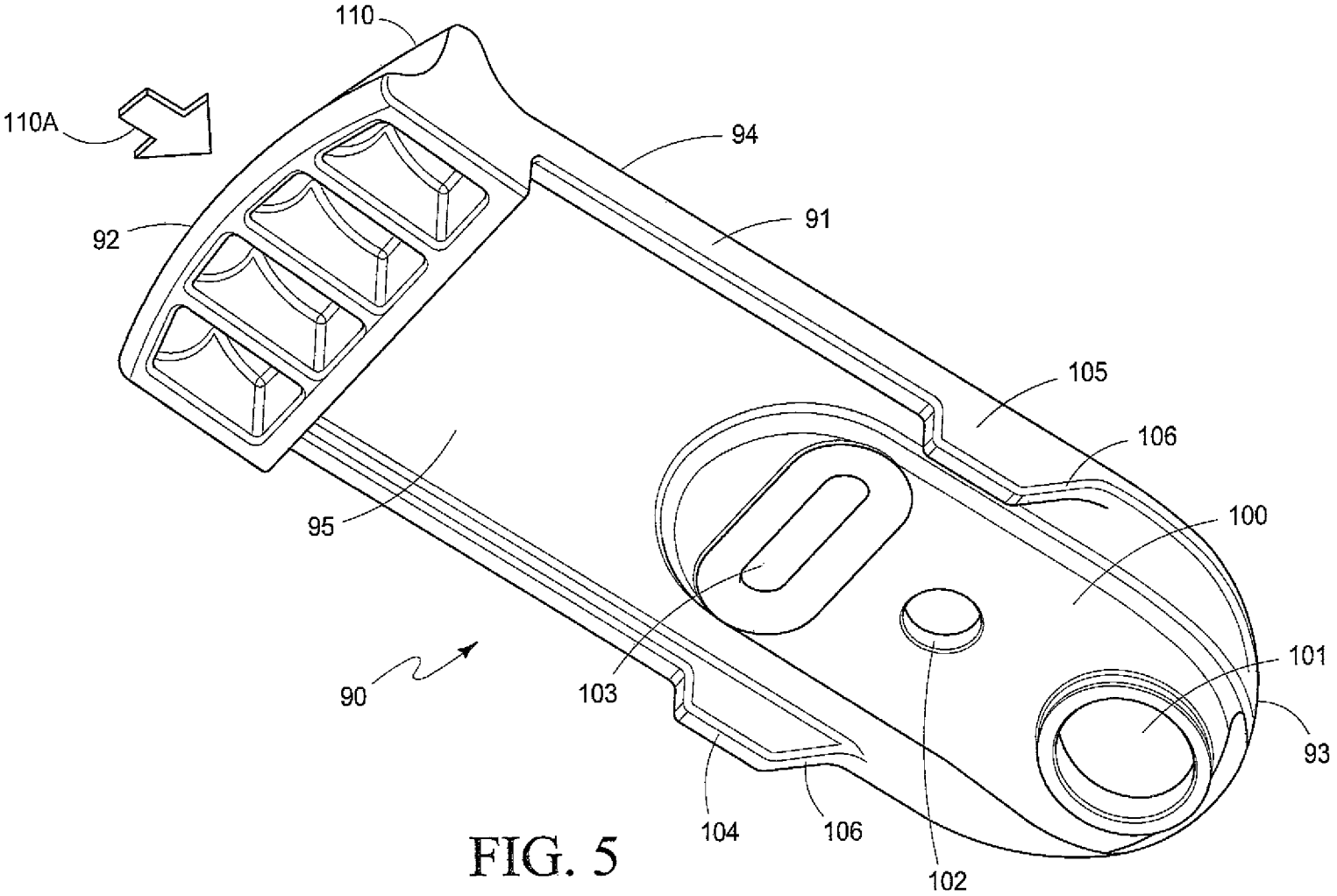
FIG. 5 is a greatly enlarged, fragmentary, perspective, bottom view of an elongated fluid dispensing member which forms a feature of the present invention, and which is illustrated without an elastomeric support member.

This disclosure of the invention is submitted in furtherance of the constitutional purposes of the U.S. Patent laws "to promote the progress of science and useful arts," [Article I, Section 8]. The liquid dispensing lid of the present invention is generally indicated by the numeral 10, and is seen in FIGS. 1 through 12, respectively. In this regard, the invention 10 is operable to cooperate with a drinking vessel 11, of conventional design. The drinking vessel 11 has a bottom or base portion 12, and an upstanding sidewall 13, which is made integral with the bottom or base portion, and which further extends generally vertically, upwardly, therefrom. The sidewall 13 has an inwardly facing surface 14, which defines an internal cavity 15. The Internal cavity 15 is operable to receive a fluid to be dispensed, and which is generally indicated by the numeral 16. The drinking vessel 11 has an upwardly oriented neck 17, and which allows the fluid 16 to be dispensed therethrough. The neck 17 is of conventional design, and typically includes an outwardly facing screw thread, not shown. This structure threadably cooperates with the liquid dispensing lid 10, as will be described, below. The drinking vessel 11 is operable to matingly cooperate with a fluid sealing gasket 18 [FIGS. 1 and 8] and which allows the liquid dispensing lid 10 to fluid sealingly cooperate or otherwise mate with the neck 17, of the drinking vessel 11.

Figure 9:
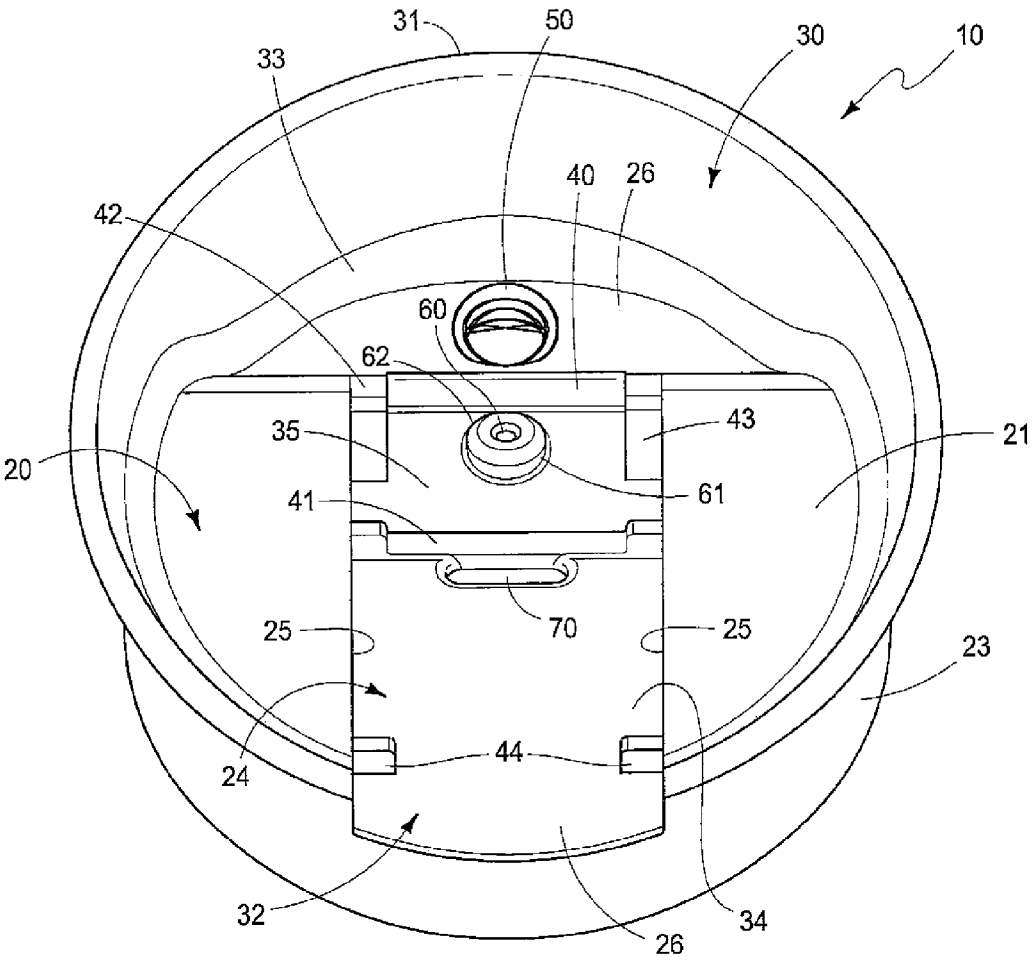
FIG. 9 is a greatly enlarged, perspective, plan view of the liquid dispensing lid of the present invention.
Figure 10:
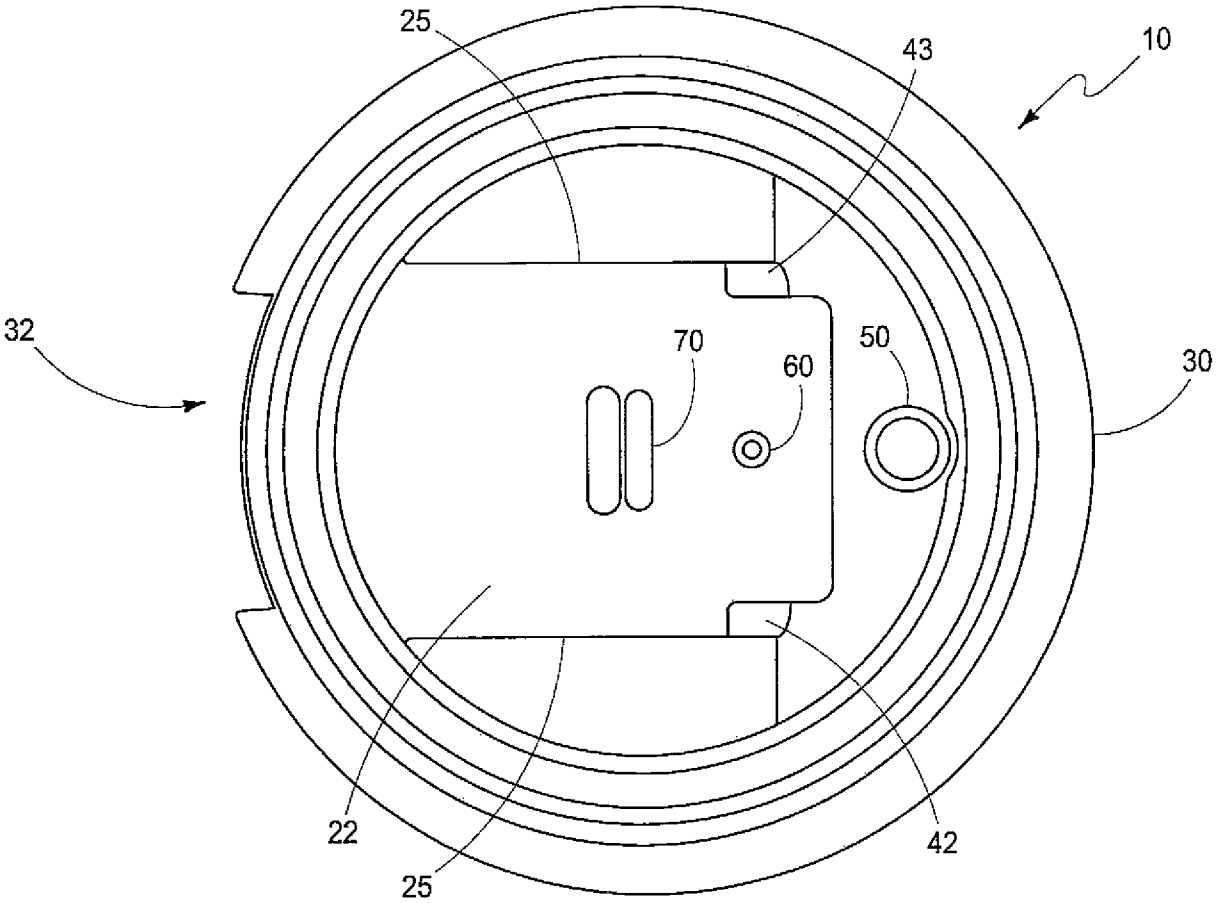
FIG. 10 is a greatly enlarged, bottom, plan view of the liquid dispensing lid of the present invention.
Figure 11:
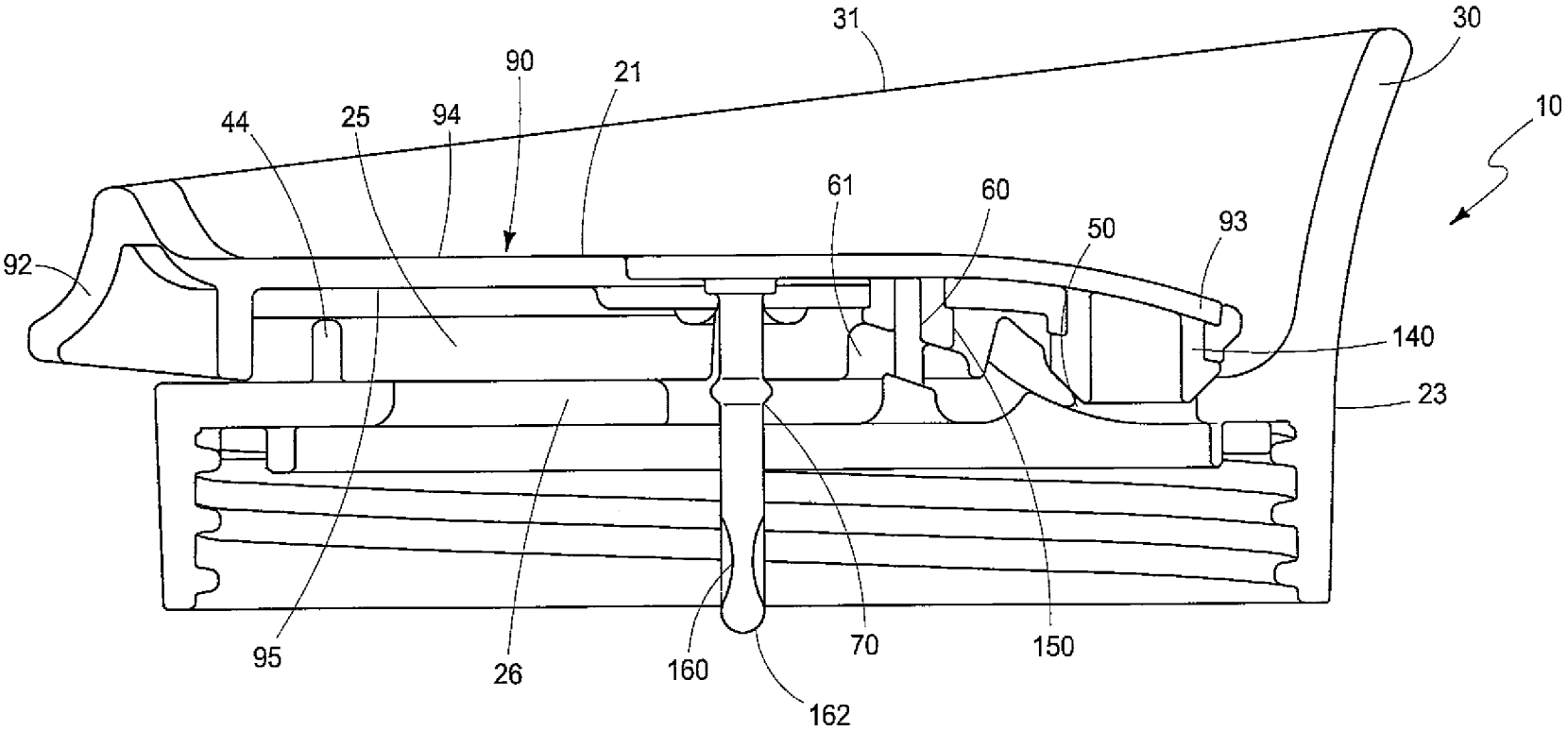
FIG. 11 is a greatly enlarged, transverse, vertical sectional view taken through the liquid dispensing lid of the present invention, and which shows the elongated fluid dispensing member in a first position which occludes a drinking and vent apertures.

The liquid dispensing lid 10 of the present invention is generally defined by a lid body here indicated by the numeral 20 (FIGS. 1 and 9). The lid body is defined by an upper or outwardly facing surface 21, and a lower surface 22. The lid body is defined by a peripheral edge 23 (FIG. 1). The lid body is generally circular in shape. As seen in FIG. 9, a cavity 24 is formed in the upper surface 21 of the lid body. The cavity 24 is defined by a pair of spaced sidewalls, here indicated by the numeral 25. The spaced sidewalls are generally parallel to each other, although other spacial arrangements for the walls are possible. Still further, the cavity 24 is defined by a bottom surface, here indicated by the numeral 26.

The lid body 20 further includes a discontinuous, upwardly extending lid body wall which is generally indicated by the numeral 30. The lid body wall 30 extends upwardly and generally radially outwardly relative to the upper surface 21. This upwardly extending lid body wall has an upper peripheral edge 31 (FIG. 9). As will be noted from the drawings, the upper peripheral edge 31 is positioned at a given height dimension, which is variable, and when measured from the upper surface 21. Still further, the discontinuous, upwardly extending lid body wall 30 defines a passageway 32, which communicates with the cavity 24, and which further is defined by the upper surface 21 of the lid body 20. The cavity 24, which is defined by the upper surface 21 of the lid body 20, includes a first region 33, a second region 34, and a third region 35. As seen in the drawings, the respective first, second and third regions each have a given depth dimension. It should be understood that the depth dimension of the first region 33 is greater than the depth dimension of the second and third regions 34 and 35, respectively. As seen in the drawings, the first region 33 is located adjacent to the upwardly extending lid body wall 30, and the upwardly extending lid body wall 30 has its greatest height dimension when measured in the vicinity of the first region 33. As further seen in the drawings, the second region 34 is adjacent to, and communicates with the passageway 32, and which is defined by the upwardly extending lid body wall 30. Still further, the third region 35 is positioned between the first 33 and second region 34, respectively.

The cavity 24, which is formed in the upper surface 21, of the lid body 20, is defined, at least in part, by first and second elevated walls 40, and which extend upwardly from the bottom surface 26 thereof (FIG. 9). The first elevated wall 40 separates the first region 33 from the third region 35; and the second elevated wall 41 which is spaced, in predetermined substantially parallel relation relative to the first elevated wall 40, separates the second region 34 from the third region 35. In the arrangement as seen in FIG. 9 the upper surface 21 of the lid body include a pair of sloped camming surfaces, here indicated as a first sloped camming surface 42, and a second sloped camming surface 43 respectively. The sloped camming surfaces are individually juxtaposed relative to each of the spaced sidewalls 25, and which define the cavity 24, and which further is formed in the upper surface 21 of the lid body 20. As seen in the drawings, the pair of sloped camming surfaces 42 and 43, respectively, are located adjacent to the first elevated wall 40. Still further, and as seen in FIG. 9, a pair of movement limiting members 44 are made integral with the bottom surface 26 of the cavity 24, and are further located near the peripheral edge 23 of the lid body 20 and in a partial occluding relationship relative to the passageway 32 which is defined, in part, by the discontinuously upwardly extending lid body wall 30. The operation of the pair of movement limiting members 44 will be discussed in greater detail, hereinafter.

As best seen by reference to FIG. 9, the upper surface 21 of the lid body 20 further defines a drinking aperture 50 which is located within the first region 33 of the cavity 24. The drinking aperture 50 communicates with the internal cavity 15 of the drinking vessel 11. Still further, the lid body 20 further defines a vent aperture 60 which is located within the third region 35 of the cavity 24, and which also communicates with the internal cavity 15 of the drinking vessel 11. As illustrated in FIG. 9, the vent aperture 61 is defined by an elevated sidewall 61 which extends upwardly from the bottom surface 26, and which defines, in part, the cavity 24. The vent aperture 60 has a sloped upwardly facing surface 62, and in which the vent aperture 60 is formed. Still further, the lid body 20 defines an elongated elastomeric biasing member aperture which is generally indicated by the numeral 70. The elongated aperture 70 is formed in the second region 34 and adjacent to the second elevated wall 41. The elastomeric biasing member aperture 70 is operable to cooperate with a biasing member which will be discussed in greater detail, hereinafter.

As best seen FIGS. 2 through 5 and 9, respectively, the lid body 20 is operable to cooperate with an elongated fluid dispensing member, and which is generally indicated by the numeral 90. The elongated fluid dispensing member as will be described, below, reciprocally moves along a path of travel, as will be described, relative to the upper surface 21 of the lid body so as to selectively occlude the drinking and vent apertures 50 and 60, respectively. The elongated fluid dispensing member 90 is sized both longitudinally and transversely so as to be matingly received within the cavity 24, and which is defined by the upper surface 21 of the lid body 20. The elongated fluid dispensing member 90 has a main body 91 with a first and second end 92 and 93, respectively, and top and bottom surfaces 94 and 95 respectively.

As will be seen in the drawings (FIG. 4), the elongated fluid dispensing member 90 has a recessed region 100 which is formed in the top surface 94, and which further is located near the second end 93 thereof. First, second and third apertures 101, 102 and 103, respectively, are formed in the recessed region 100, and extend through main body 91, and between the top and bottom surfaces 94 and 95, respectively. Still further, and referring now to FIGS. 3, 4 and 5, first and second cam followers 104 and 105, respectively, are made integral with and extend downwardly relative to the bottom surface 95. The first and second cam followers 104 and 105, respectively, are located between the first and second ends 92 and 93 of the main body 91. The first and second cam followers 104 and 105 each have a sloped or angled peripheral edge 106. The peripheral edges 106 of the respective first and second cam followers 104 and 105 are operable to moveably cooperate, or otherwise slideably mate thereagainst the first and second sloped camming surfaces 42 and 43, respectively, when the elongated fluid dispensing member 90 is appropriately moveably mounted on, and disposed within the cavity 24, and which is defined by the lid body 20. The moveable cooperation of the respective peripheral edges 106 with the sloped first and second camming surfaces 42 and 43, respectively, define a course of travel for the elongated fluid dispensing member 90 which will be described in greater detail, below. The elongated fluid dispensing member 90 as seen in the drawings, extends, at least in part, radially, outwardly through the passageway 32, and which is defined by the discontinuous upwardly extending lid body wall 30 and to a given distance from the peripheral edge 23 of the lid body 20. The elongated fluid dispensing member 90 further includes a force receiving member 110 which is mounted on the first end 92 of the elongated fluid dispensing member 90, and which is operable to receive a physical force 110A and which is applied by a user to the first end thereof. An engagement member 111 is made integral with the bottom surface 95 and further cooperates with the pair of movement limiting members 44. The physical force 110A which is applied to the first end 92 is effective in moving the elongated fluid dispensing member 90 along a reciprocal path of travel 112, from a first position 113, and where the elongated fluid dispensing member 90 is located in an orientation where the drinking aperture 50 and vent aperture 60 are substantially occluded, and which prevents any liquid 16 which is enclosed within the drinking vessel 11 from escaping from the drinking vessel; and a second position 114, and where the elongated fluid dispensing member 90 is located in a non-occluding position relative to the drinking aperture 50, and vent aperture 60, respectively. In the non-occluding position, the movement limiting members 44 are juxtaposed relative to the engagement member 111.

Figure 12:
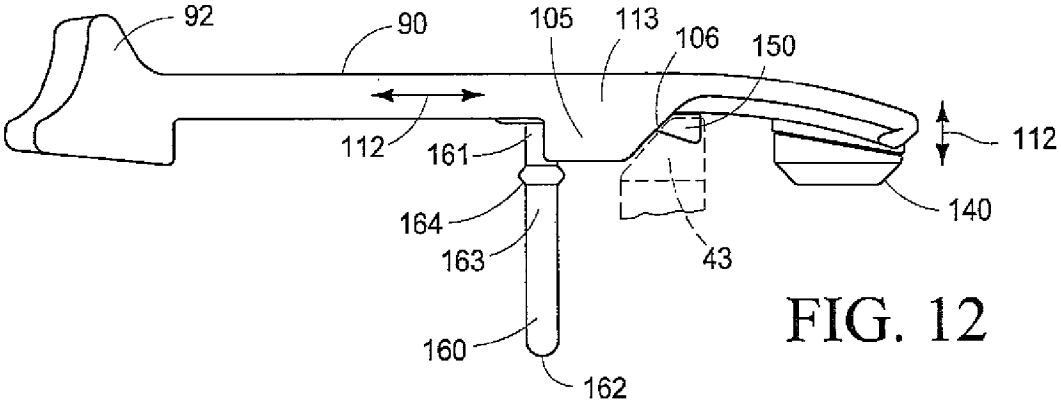
FIG. 12 is a greatly enlarged, fragmentary, side elevation view of an elongated fluid dispensing member which forms a feature of the present invention, and which is shown in a first position which occludes a drinking and vent apertures.
Figure 12A:
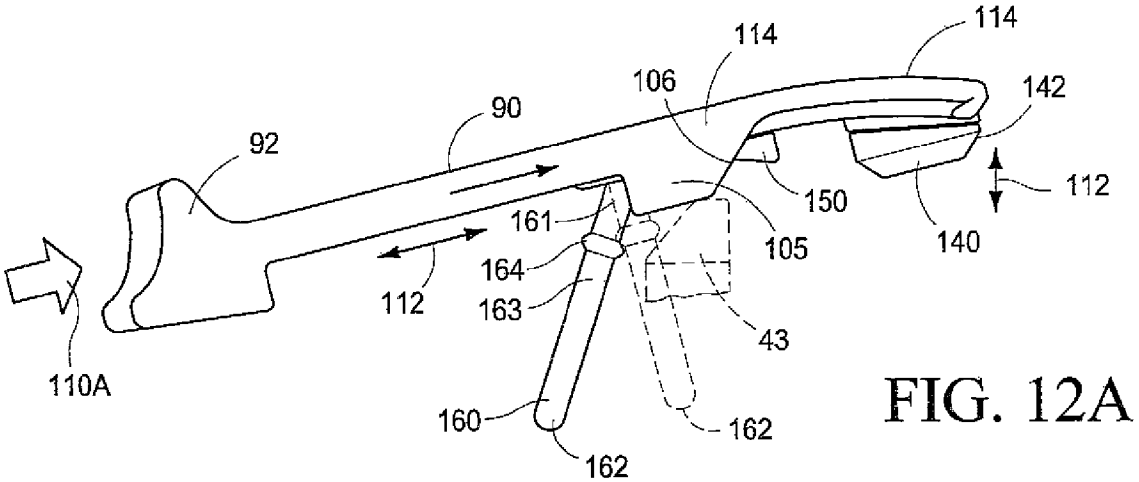
FIG. 12A is a second, greatly enlarged, side elevation view of the elongated fluid dispensing member of FIG. 12, and which is shown in a second position and where the previously mentioned drinking and vent apertures are then in a non-occluded state.

The engagement of the peripheral edges 106, of the first and second cam followers 104 and 105, respectively, with the first and second camming surfaces 42, and 43, respectively, is effective in locating the elongated fluid dispensing member 90 in an appropriate non-occluding orientation relative to the drinking aperture 50, and vent aperture 60, respectively. This is seen in FIGS. 12 and 12A, respectively.

Figure 6:
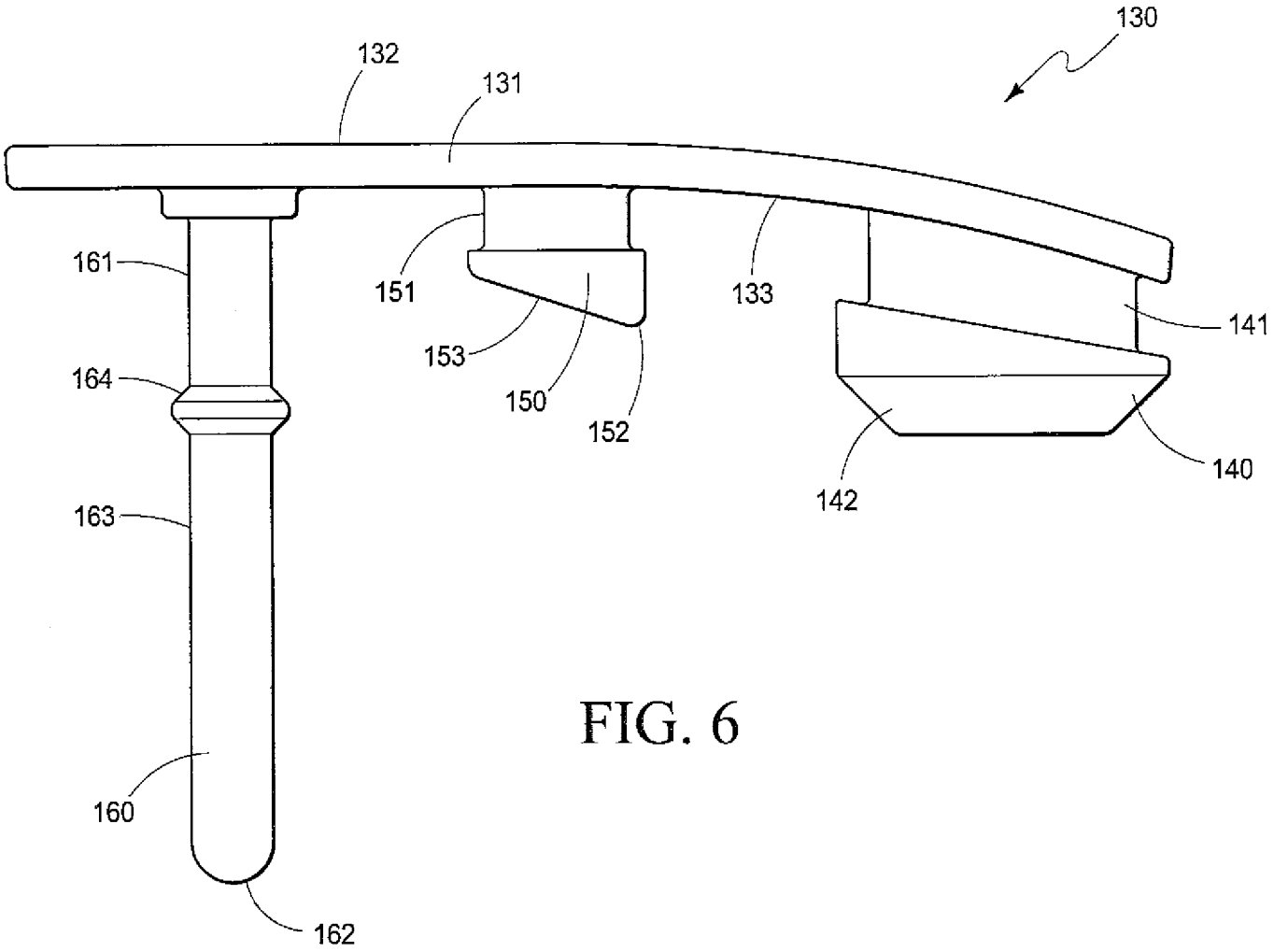
FIG. 6 is a greatly enlarged, side elevation view of an elastomeric engagement member, and which includes a drinking aperture sealing member, vent aperture sealing member, and a biasing member, all of which form features of the present invention.
Figure 7:
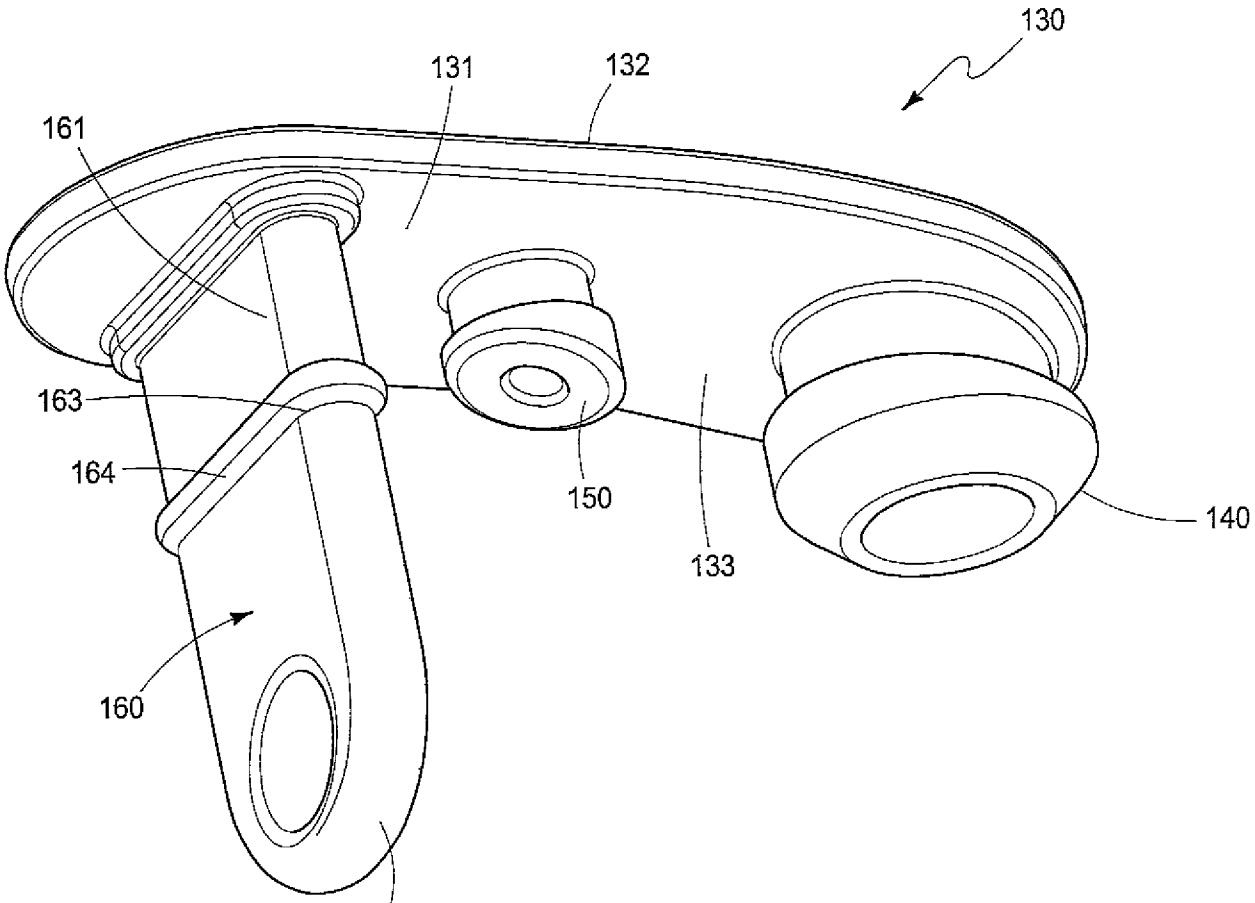
FIG. 7 is a greatly enlarged, perspective, bottom view of the elastomeric engagement member having the drinking aperture sealing member, vent aperture sealing member and the biasing member, all of which form features of the present invention.
Figure 8:
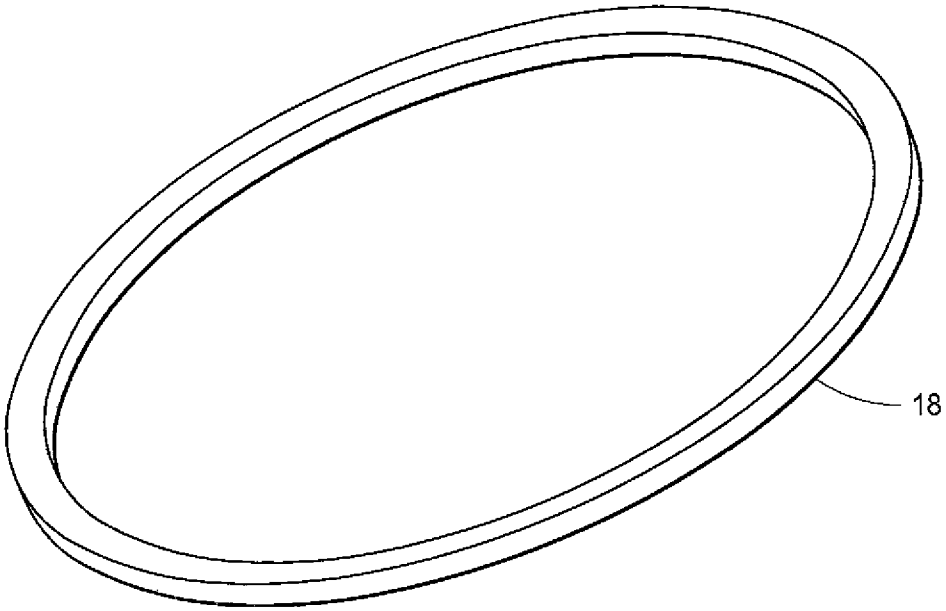
FIG. 8 is a greatly enlarged, perspective view of a fluid sealing gasket which forms a feature of the present invention.

The liquid dispensing lid 10 of the present invention includes an elastomeric engagement member which is generally indicated by the numeral 130. The elastomeric engagement member 130 is sized so as to be matingly received within the recessed region 100, and positioned in a substantially co-planar relationship relative to the top surface 94 of the elongated fluid dispensing member 90, and in a substantially co-planar orientation with the upper surface 21 of the lid body when the elongated dispensing member is in the first position 113. This is best seen by reference to FIG. 1. The elastomeric engagement member has a main body 131 which is flexible, and which further has a top surface 132, and an opposite bottom surface 133 (FIG. 6). Made integral with, and extending downwardly relative to the bottom surface 133 is a drinking aperture sealing member 140; vent aperture sealing member 150; and an elastomeric biasing member 160, respectively.

The drinking aperture sealing member 140, which is best illustrated in FIG. 6, includes an intermediate portion 141, and which has a cross sectional or outside diametral dimension which is less than the cross-sectional or outside diametral dimension of the distal end 142. The distal end 142 is operable to occlude the drinking aperture 50, and which is formed in the lid body 20. Still further the vent aperture sealing member 150, and which is located in spaced relation relative to the drinking aperture sealing member 140, has an intermediate portion 151, and which has an outside diametral dimension which is less than the distal end 152 thereof. Still further, the distal end 152 has a slanted or angulated engagement surface 153 which is operable to engage or come into sealing contact relative to the sloped, top surface 62 (FIG. 9) of the vent aperture 60, as earlier described. Still further the elastomeric biasing member 160 includes a proximal end 161, which is made integral with the bottom surface of 133 of the elastomeric engagement member, and which further has an opposite, distal end 162. Still further the elastomeric biasing or engagement member has an intermediate portion 163, and wherein an enlarged engagement portion 164 is made integral with the Intermediate portion and is operable to forcibly engage the lower surface 22 of the lid body 20 when properly installed in the elastomeric biasing aperture 70. It should be understood the drinking aperture sealing member 140, vent aperture sealing member 150, and elastomeric biasing member 160 can be deformedly passed through the respective drinking aperture 50, vent aperture 60 and elastomeric biasing aperture 70 such that the drinking aperture sealing member 140, vent aperture sealing member 150, and elastomeric engagement member 160 depend downwardly relative to the elongated fluid dispensing member 90. Still further it should be appreciated that the distal end 162, and intermediate portion 163 of the elastomeric biasing member are sized, and resiliently deformable so as to pass through the elastomeric biasing aperture 70. When the intermediate portion 163 passes through the elastomeric biasing aperture 70, the engagement portion 164 is operable to forcibly engage the lower surface 22 of the lid body 20. When located in this position, the reciprocal movement of the elongated fluid dispensing member 90 along the reciprocal path of travel 112 is operable to elongate the intermediate portion, thus providing a biasing force which urges the elongated fluid dispensing member 90 to move from the second position 114, back in the direction of the first position 113 when the force 110A is removed from the force receiving member 110 (See FIG. 12A). Further, the arrangement of the elastomeric engagement member 130 bearing the drinking aperture sealing member 140, vent aperture sealing member 150, and elastomeric biasing member 160 is such that this assembly can be readily removed from the elongated fluid dispensing member 90, and then cleansed, and reassembled, so that the fluid dispensing lid 10 of the present invention can be used with assorted fluids 16 to be dispensed.

Operation

The operation of the described embodiment of the present invention is believed to be readily apparent, and is briefly summarized at this point.

In its broadest aspect, the present invention, as disclosed, includes a liquid dispensing lid 10 which is defined by a lid body 20 having an upper and lower surface 21 and 22, respectively, and a peripheral edge 23. The lid body 20 is sized so as to releasably cooperate with a fluid dispensing vessel 11 having an internal cavity 15. The lid body 20 further defines a drinking aperture 50. The liquid dispensing lid 10 also includes an elongated, fluid dispensing member 90 which movably cooperates with the upper surface of the lid body 20 so as to selectively occlude the drinking aperture 50. Still further the liquid dispensing lid of the present invention includes an elastomeric biasing member 160 which biasingly couples the elongated, fluid dispensing member 90 to the lid body 20, and which further biasingly urges the elongated, fluid dispensing member 90 into an orientation 113, and where the elongated fluid dispensing member 90 occludes the drinking aperture 50.

More specifically, the liquid dispensing lid 10 of the present invention includes a lid body 20 having an upper and lower surface 21 and 22, respectively, and a peripheral edge 23. The lid body 20 is sized so as to releasably cooperate with a fluid dispensing vessel 11 having an internal cavity 15. The lid body 20 further defines a drinking aperture 50, and a vent aperture 60, which individually communicate with the internal cavity 15 of the fluid dispensing vessel 11. The present invention includes an elongated fluid dispensing member 90 which reciprocally moves along a path of travel 112 relative to the upper surface 21, of the lid body 20, so as to selectively occlude the drinking, and vent apertures 50 and 60, respectively. The Invention 10 further includes a drinking aperture sealing member 140 which is borne by the elongated fluid dispensing member 90, and which selectively and sealably cooperates with the drinking aperture 50. The present invention also includes a vent sealing member 150 which is borne by the elongated fluid dispensing member 90, and which selectively and sealably cooperates with the vent aperture 60. Finally, the invention 10 includes an elastomeric biasing member 160 which is borne by the elongated fluid dispensing member 90, and which further is coupled to the lid body 20. The elastomeric biasing member 160 biasingly urges the elongated fluid dispensing member 90 to move along the path of travel 112 in a given direction so as to selectively occlude the drinking and vent apertures 50 and 60, respectively.

More specifically, the present invention relates to a liquid dispensing lid 10 which includes a lid body 20 having an upper and lower surface 21 and 22, respectively and a peripheral edge 23. The lid body 20 is sized so as to releasably cooperate with a fluid dispensing vessel 11 having an internal cavity 15. The lid body 20 further defines a drinking aperture 50, a vent aperture 60, and an elastomeric biasing aperture 70 which individually communicate with the internal cavity 15 of the fluid dispensing vessel 11. A cavity 24 is defined by the upper surface 21, of the lid body 20. The lid body 20 is generally circular in shape, and the cavity 24 which is formed in the upper surface 21 of the lid body 20 extends, generally radially, inwardly relative to the peripheral edge 23 of the lid body. The cavity 24 is defined, at least in part, by a bottom surface 26. The vent aperture 60 drinking aperture 50, and the elastomeric biasing aperture 70 are formed in the bottom surface 26 of the cavity 24. A discontinuous, upwardly extending lid body wall 30 is made integral with the peripheral edge 23 of the lid body 20, and further defines a passageway 32 which communicates with the cavity 24, and which is formed in the upper surface of the lid body 20.

The present invention 10 includes an elongated fluid dispensing member 90 which reciprocally moves along a path of travel 112 relative to the upper surface 21 of the lid body 20, so as to selectively occlude the drinking and vent apertures 50 and 60, respectively. The elongated fluid dispensing member 90 is sized so as to be matingly received in the cavity 24, and which is defined by the upper surface 21 of the lid body 20. The elongated, fluid dispensing member 90 has a main body 91, with a first and second end 92 and 93, respectively; top and bottom surfaces 94 and 95, respectively; and a recessed region 100 which is formed in the top surface 94, thereof. The recessed region 100 is located near the second end 93 of the main body 91, and further has a given shape. An elastomeric engagement member 130 is provided, and which is sized so as to be matingly received within the recessed region 100, and positioned in a substantially co-planar relationship relative to the upper surface 21 of the lid body 20. The recessed region 100 further has formed therein first, second, and third apertures 101, 102 and 103, respectively, and which extend through the elongated fluid dispensing member 90. The elongated fluid dispensing member 90 further has a pair of downwardly depending cam followers here indicated by the numerals 104 and 105, respectively, and which are made integral with the bottom surface 95 of the elongated fluid dispensing member 90. Each of the cam followers has a peripheral edge 106 which moveably and slideably cooperates with the upper surface 21 of the lid body 20, (the first and second sloped camming surfaces 42, and 43) and which are located within the cavity 24. The reciprocal moveable cooperation of the elongated fluid dispensing member 90 relative to the lid body 20 is effective in urging the downwardly depending cam followers 104 and 105, respectively, to reciprocally move along a portion of the upper surface 21 of the lid body 20, and effect a corresponding reciprocal movement of the elongated fluid dispensing member 90 along the path of travel 112, from a first, occluding position 113 relative to the drinking and vent apertures 50 and 60 respectively, to a second, non-occluding position 114 relative thereto.

The present invention 10 also includes a drinking aperture sealing member 140 which is made integral with the elastomeric engagement member 130, and which further depends downwardly from the elongated fluid dispensing member 90, and selectively cooperates with the drinking aperture 50. The present invention 10 also includes a vent sealing member 150 which is made integral with the elastomeric engagement member 130, and which further depends downwardly from the elongated fluid dispensing member 90, and selectively cooperates with the vent aperture 60. The drinking aperture sealing member 140, and the vent aperture sealing member 150 are both sized and are resiliently deformable so as to individually pass through the first and second apertures 101 and 102, respectively, and which are formed in the elongated fluid dispensing member 90.

The present invention also includes an elastomeric biasing member 160 which is made integral with the elastomeric engagement member 130, and which further depends downwardly from the elongated fluid dispensing member 90. The biasing member 160 is further coupled to the lid body 20. The elastomeric biasing member 160 biasingly urges the elongated fluid dispensing member 90 to move along the path of travel 112 in a given direction (towards the first position 113) so as to occlude the drinking and vent apertures 50 and 60, respectively. The biasing member 160 is located in spaced relation relative to the drinking and vent aperture sealing members 140 and 150, respectively, and further has a main body 163 which passes through the third aperture 103 which is formed in the elongated fluid dispensing member 90. The biasing member 160 has a first end 161 which cooperates with the elongated fluid dispensing member, and an opposite second 162 which is resiliently deformable so as to pass through the elastomeric biasing aperture 70. A portion 164 of biasing member 160 which is located between the first end 161 and the second end 162 of the biasing member 160 matingly and forcibly cooperates with the lower surface 22 of the lid body 20. The first end 161 of the biasing member is forcibly retained in cooperation with the elongated fluid dispensing member 90 by the action of the elastomeric engagement member 130. The movable cooperation of the elongated fluid dispensing member 90 relative to the lid body 20 is effective in urging the downwardly depending cam followers, 104 and 105, to reciprocally move along the upper surface 21 of the lid body 20 (the first and second camming surfaces 42, and 43) and effect a corresponding movement of the elongated fluid dispensing member 90 along the path of travel 112, from the first position 113, and wherein the respective drinking aperture sealing member 140, and vent aperture sealing members 150, are located in an occluding position relative to the drinking aperture 50, and vent aperture 60, respectively, to a second position 114 (see FIGS. 12 and 12A, respectively). In the position 114, the drinking aperture sealing member 140, and vent sealing member 150 are both located in a non-occluding position relative to the drinking and vent apertures 50 and 60 respectively. The elastomeric biasing member 160 biasingly elongates when the elongated fluid dispensing member 90 moves from the first to the second positions 113 and 114 respectively (FIG. 12A). The elongated biasing member 160 forcibly returns the elongated fluid dispensing member 90 from the second position 114, to the first position 113, and along the path of travel 112 when force 110A is removed from the first end 92 of the fluid dispensing member 90.

Therefore it will be seen that the present invention provides a convenient means for dispensing liquid and which is particularly novel over the teachings of the prior art. The present invention provides increased convenience inasmuch as the fluid dispensing lid 10 may be readily disassembled so that it may be cleaned and kept in a sanitary condition. The invention is reliable, retains a liquid within the drinking vessel until desired by the user, and further can be easily operated by one hand.

In compliance with the statute, the invention has been described in language more or less specific as to structural and methodical features. It should be understood, however, that the invention is not limited to the specific features shown and described since the means herein disclosed comprise preferred forms of putting the invention into effect. The invention is, therefore, claimed in any of its forms or modifications within the proper scope of the appended claims appropriately interpreted in accordance with the Doctrine of Equivalence.

We claim:

1. A liquid dispensing lid comprising:

a lid body having an upper and lower surface, and a peripheral edge, and wherein the lid body is sized so as to releasably cooperate with a fluid dispensing vessel having an internal cavity, and wherein the lid body further defines a drinking aperture, and wherein a vent aperture is formed in the lid body and is further located in spaced relation relative to the drinking aperture, and wherein the drinking aperture, and vent aperture each extend through the lid body, and communicate with the internal cavity of the fluid dispensing vessel, and wherein an elastomeric biasing member aperture is formed in the lid body, and which further extends through the upper and lower surfaces thereof, and wherein a cavity is defined by the upper surface of the lid body, and wherein the lid body is generally circular in shape, and the cavity formed in the upper surface of the lid body extends, generally radially inwardly relative to the peripheral edge of the lid body, and wherein the cavity is defined, at least in part, by a pair of spaced sidewalls, and a bottom surface, and wherein the vent aperture, drinking aperture, and the elastomeric biasing member aperture are formed in the bottom surface of the cavity, and wherein a sloped camming surface juxtaposed relative to at least one of the sidewalls that define the cavity, and which is formed in the upper surface of the lid body, and wherein a discontinuous, upwardly extending lid body wall is made integral with peripheral edge of the lid body, and further defines a passageway which coaxially communicates with the cavity which if formed in the upper surface of the lid body;

an elongated, fluid dispensing member which moveably cooperates with the upper surface of the lid body so as to selectively occlude the drinking aperture, and wherein the elongated fluid dispensing member is sized so as to be matingly received in the cavity, and located between the pair of spaced sidewalls; and an elastomeric biasing member which biasingly couples the elongated, fluid dispensing member to the lid body, and which further biasingly urges the elongated, fluid dispensing member into an orientation where the elongated, fluid dispensing member occludes the drinking aperture.

2. A liquid dispensing lid as claimed in claim 1, and wherein the cavity which is formed in the upper surface of the lid body has a first, second, and third region, and wherein the respective first, second and third regions each have a given depth dimension, and wherein the depth dimension of the first region is greater than the depth dimension of the second and third regions, and wherein the drinking aperture is located in the first region, the vent aperture is located in the third region, and the elastomeric biasing aperture is formed in the second region of the cavity, and wherein the first region is located adjacent to the upwardly extending lid body wall, and the second region is adjacent to, and communicates with, the passageway, and which is defined by the upwardly extending lid body wall, and wherein the third region is positioned between the first and second regions.

3. A liquid dispensing lid as claimed in claim 2, and further comprising:

a drinking aperture sealing member which is borne by the elongated, fluid dispensing member, and which is operable to selectively occlude the drinking aperture as the elongated, fluid dispensing member moveably cooperates with the lid body; and a vent aperture sealing member which is borne by the elongated, fluid dispensing member, and which is further located in spaced relation relative to the drinking aperture sealing member, and wherein the vent aperture sealing member is operable to selectively occlude the vent aperture as the elongated, fluid dispensing member moveably cooperates with the lid body, and wherein the biasing member is located in spaced relation relative to the vent aperture sealing member, and further has a main body which has a first end which cooperates with the elongated, fluid dispensing member, and an opposite, second end which passes through the elastomeric biasing aperture, and wherein a portion of the biasing member matingly cooperates with the lower surface of the lid body.

4. A liquid dispensing lid as claimed in claim 3, and further comprising:

an elastomeric engagement member which cooperates with the elongated, fluid dispensing member, and wherein the drinking aperture sealing member, vent aperture sealing member, and the biasing member are each made integral with the elastomeric engagement member, and depend downwardly relative thereto, and wherein the first end of the biasing member is forcibly retained in cooperation with the elongated, fluid dispensing member by the elastomeric engagement member.

5. A liquid dispensing lid as claimed in claim 4, and wherein the main body of the elongated, fluid dispensing member has a first and second end, top and bottom surfaces, and a recessed region which is formed in the top surface thereof, and wherein the recessed region is located near the second end of the main body, and further has a given shape, and wherein the elastomeric engagement member is sized so as to be matingly received within the recessed region, and wherein the recessed region further has formed therein first, second and third apertures which extend through the elongated, fluid dispensing member, and which are individually sized so as to permit the passing of the respective drinking aperture sealing member, vent aperture sealing member, and biasing member therethrough the first, second, and third apertures respectively, and wherein the drinking aperture sealing member, vent aperture sealing member, and the biasing member depend downwardly relative to the bottom surface of the elongated, fluid dispensing member when the elastomeric engagement member is matingly received within the recessed region of the elongated, fluid dispensing member.

6. A liquid dispensing lid as claimed in claim 5, and wherein the elongated, fluid dispensing member further comprises:

a downwardly depending cam follower which is made integral with the bottom surface of the elongated, fluid dispensing member, and which further has a peripheral edge which moveably cooperates with the sloped camming surface, and wherein the movable cooperation of the elongated fluid dispensing member relative to the lid body is effective in urging the downwardly depending cam follower to reciprocally move along the sloped camming surface, and effect a corresponding movement of the elongated, fluid dispensing member along a path of travel from a first position, and wherein the respective drinking aperture sealing member, and vent aperture sealing member are located in an occluding position relative to the drinking aperture, and vent apertures, respectively, to a second position, and wherein the drinking aperture sealing member and vent sealing member are located in a non-occluding position relative to the drinking and vent apertures, respectively, and wherein the elastomeric biasing member biasingly elongates when the elongated fluid dispensing member moves from the first to the second position, and wherein the elongated biasing member forcibly returns the elongated, fluid dispensing member from the second position to the first position.

7. A liquid dispensing lid as claimed in claim 6, and wherein the first end of the elongated fluid dispensing member extends radially outwardly through the passageway which is defined by the discontinuous, upwardly extending lid body wall and to a given distance from the peripheral edge of the lid body, and wherein a physical force applied by a user to the first end of the elongated, fluid dispensing member is effective in moving the elongated, fluid dispensing member along the path of travel from the first position to the second position, and wherein a release of the physical force applied to the first end of the elongated, fluid dispensing vessel permits the elongated, fluid dispensing member to move from the second position, to the first position under the biasing force applied by the elongated biasing member, and wherein, in the first position, the top surface of the elongated fluid dispensing member is oriented in a substantially co-planar position relative to the upper surface of the lid body, and wherein, when located in the second position, the top surface is oriented in a non co-planar orientation relative thereto.

8. A liquid dispensing lid as claimed in claim 7, and wherein the elastomeric engagement member having the drinking aperture sealing member, vent aperture sealing member, and the biasing member is easily removed from the elongated, fluid dispensing member so as to facilitate the cleansing of the liquid dispensing lid, and the elastomeric engagement member.

9. A liquid dispensing lid, comprising:

a lid body having an upper and lower surface, and a peripheral edge, and wherein the lid body is sized so as to releasably cooperate with a fluid dispensing vessel having an internal cavity, and wherein the lid body further defines a drinking aperture, and a vent aperture, which individually communicate with the internal cavity of the fluid dispensing vessel, and wherein a cavity is defined by the upper surface of the lid body, and wherein the lid body is generally circular in shape, and the cavity formed in the upper surface of the lid body extends, generally radially, inwardly, relative to the peripheral edge of the lid body, and wherein the cavity is defined, at least in part, by a pair of spaced sidewalls, and a bottom surface, and wherein the vent aperture, drinking aperture, and an elastomeric biasing aperture are formed in the bottom surface of the cavity, and wherein a pair of sloped camming surfaces are individually juxtaposed relative to each of the sidewalls that define the cavity, and which is formed in the upper surface of the lid body, and a discontinuous, upwardly extending lid body wall is further made integral with peripheral edge of the lid body, and wherein the discontinuous, upwardly extending lid body wall defines a passageway which coaxially communicates with the cavity which is formed in the upper surface of the lid body, and wherein the discontinuous, upwardly extending lid body wall has a height dimension when measured from the upper surface of the lid body which is non-uniform;

an elongated fluid dispensing member which reciprocally moves along a given path of travel relative to the upper surface of the lid body so as to selectively occlude the drinking and vent apertures;

a drinking aperture sealing member borne by the elongated fluid dispensing member, and which selectively cooperates with the drinking aperture;

a vent sealing member borne by the elongated fluid dispensing member, and which selectively cooperates with the vent aperture; and an elastomeric biasing member which is borne by the elongated fluid dispensing member, and which is further coupled to the lid body, and wherein the elastomeric biasing member biasingly urges the elongated fluid dispensing member to move along the path of travel in a given direction so as to occlude the drinking and vent apertures, respectively.

10. A liquid dispensing lid as claimed in claim 9, and wherein the cavity which is formed in the upper surface of the lid body has a first, second, and third region, and wherein the respective first, second and third regions each have a given depth and width dimension, and wherein the depth and width dimensions of the first region is greater than the depth and width dimensions of the second and third regions, and wherein the drinking aperture is located in the first region, the vent aperture is located in the third region, and the elastomeric biasing aperture is formed in the second region of the cavity, and wherein the first region is located adjacent to the upwardly extending lid body wall, and the second region is adjacent to, and communicates with, the passageway, and which is defined by the upwardly extending lid body wall, and wherein the third region is positioned between the first and second regions, and wherein the vent aperture is located elevationally, above, the bottom surface of the cavity, and within the third region, and wherein an elevated wall separates the first, second and third regions of the cavity.

11. A liquid dispensing lid as claimed in claim 10, and wherein the biasing member is located in spaced relation relative to the drinking and vent aperture sealing members, and further has a main body which has a first end which cooperates with the elongated, fluid dispensing member, and an opposite, second end which passes through the elastomeric biasing aperture, and wherein a portion of the biasing member matingly cooperates with the lower surface of the lid body, and wherein an elastomeric engagement member cooperates with the elongated, fluid dispensing member, and the drinking aperture sealing member, vent aperture sealing member, and the biasing member are each made integral with the elastomeric engagement member, and further individually depend downwardly relative thereto, and wherein the first end of the biasing member is forcibly retained in cooperation with the elongated, fluid dispensing member by the elastomeric engagement member.

12. A liquid dispensing lid as claimed in claim 11, and wherein the elongated, fluid dispensing member has a main body with a first and second end, top and bottom surfaces, and a recessed region which is formed in the top surface thereof, and wherein the recessed region is located near the second end of the main body, and further has a given shape, and wherein the elastomeric engagement member is sized so as to be matingly received within the recessed region, and positioned in a substantially co-planar relationship relative to the upper surface of the lid body, and wherein the recessed region further has formed therein first, second and third apertures which extend through the elongated, fluid dispensing member, and which are sized so as to permit the passing of the respective drinking aperture sealing member, vent aperture sealing member, and biasing member therethrough the first, second, and third apertures respectively, and wherein the elongated, fluid dispensing member further has a pair of downwardly depending cam followers which are made integral with the bottom surface of the elongated, fluid dispensing member, and which further each have a peripheral edge which moveably cooperates with the respective sloped camming surface, and wherein the reciprocal movable cooperation of the elongated fluid dispensing member relative to the lid body is effective in urging each of the downwardly depending cam followers to reciprocally move along the respective, sloped camming surfaces, and effect a corresponding, reciprocal movement of the elongated, fluid dispensing member along the path of travel from a first, occluding position relative the drinking and vent apertures, respectively, to a second non-occluding position relative thereto.

13. A liquid dispensing lid, comprising:

a lid body having an upper and lower surface, and a peripheral edge, and wherein the lid body is sized so as to releasably cooperate with a fluid dispensing vessel having an internal cavity, and wherein the lid body further defines a drinking aperture, a vent aperture, and an elastomeric biasing aperture each of which communicates with the internal cavity of the fluid dispensing vessel, and wherein a cavity is defined by the upper surface of the lid body, and wherein the lid body is generally circular in shape, and the cavity formed in the upper surface of the lid body extends, generally radially, inwardly relative to the peripheral edge of the lid body, and wherein the cavity is defined, at least in part, by a bottom surface, and wherein the vent aperture, drinking aperture, and the elastomeric biasing aperture are formed in the bottom surface of the cavity, and wherein a discontinuous, upwardly extending lid body wall is made integral with peripheral edge of the lid body, and further defines a passageway which communicates with the cavity which is formed in the upper surface of the lid body;

an elongated fluid dispensing member which reciprocally moves along a path of travel relative to the upper surface of the lid body so as to selectively occlude the drinking and vent apertures, and wherein the elongated fluid dispensing member is sized so as to be matingly received in the cavity which is defined by the upper surface of the lid body, and wherein the elongated, fluid dispensing member has a main body with a first and second end, top and bottom surfaces, and a recessed region which is formed in the top surface thereof, and wherein the recessed region is located near the second end of the main body, and further has a given shape, and wherein an elastomeric engagement member is sized so as to be matingly received within the recessed region, and positioned in a substantially co-planar relationship relative to the top surface of the main body, and the upper surface of the lid body, and wherein the recessed region further has formed therein first, second and third apertures which extend through the elongated, fluid dispensing member, and wherein the elongated, fluid dispensing member further has a downwardly depending cam follower which is made integral with the bottom surface of the elongated, fluid dispensing member, and which further has a peripheral edge which moveably cooperates with the upper surface of the lid body, and which is located within the cavity, and wherein the reciprocal movable cooperation of the elongated fluid dispensing member relative to the lid body is effective in urging the downwardly depending cam follower to reciprocally move along a portion of the upper surface of the lid body, and effect a corresponding reciprocal movement of the elongated, fluid dispensing member along the path of travel from a first, occluding position relative the drinking and vent apertures, respectively, to a second, non-occluding position relative thereto;

a drinking aperture sealing member which is made integral with the elastomeric engagement member, and which further depends downwardly from the elongated fluid dispensing member, and selectively cooperates with the drinking aperture;

a vent sealing member which is made integral with the elastomeric engagement member, and which further depends downwardly from the elongated fluid dispensing member, and selectively cooperates with the vent aperture, and wherein the drinking aperture sealing member, and the vent aperture sealing member are both sized so as to individually pass through the first and second apertures, respectively, and which are formed in the elongated fluid dispensing member; and an elastomeric biasing member is made integral with the elastomeric engagement member, and which further depends downwardly from the elongated fluid dispensing member, and wherein the biasing member is further coupled to the lid body, and wherein the elastomeric biasing member biasingly urges the elongated fluid dispensing member to move along the path of travel in a given direction so as to occlude the drinking and vent apertures, respectively, and wherein the biasing member is located in spaced relation relative to the drinking and vent aperture sealing members, and further has a main body which passes through the third aperture which is formed in the elongated fluid dispensing member, and wherein the biasing member has a first end which cooperates with the elongated, fluid dispensing member, and an opposite, second end which passes through the elastomeric biasing aperture, and wherein the second end of the biasing member matingly cooperates with the lower surface of the lid body, and wherein the first end of the biasing member is forcibly retained in cooperation with the elongated, fluid dispensing member by the elastomeric engagement member, and wherein the movable cooperation of the elongated fluid dispensing member relative to the lid body is effective in urging the downwardly depending cam follower to reciprocally move along the upper surface of the lid body, and effect a corresponding movement of the elongated, fluid dispensing member along the path of travel from the first position, and wherein the respective drinking aperture sealing member, and vent aperture sealing member are located in an occluding position relative to the drinking aperture, and vent apertures, respectively, to a second position, and where the drinking aperture sealing, and vent sealing members are located in a non-occluding position relative to the drinking and vent apertures, respectively, and wherein the elastomeric biasing member biasingly elongates when the elongated fluid dispensing member moves from the first to the second position, and wherein the elongated biasing member forcibly returns the elongated, fluid dispensing member from the second position to the first position and along the path of travel.

14. A liquid dispensing lid as claimed in claim 13, and wherein the first end of the elongated fluid dispensing member extends radially outwardly through the passageway which is defined by the discontinuous, upwardly extending lid body wall and to a given distance from the peripheral edge of the lid body, and wherein a physical force applied by a user to the first end of the elongated, fluid dispensing member is effective in moving the elongated, fluid dispensing member along the path of travel from the first position to the second position, and wherein a release of the physical force applied to the first end of the elongated, fluid dispensing vessel permits the elongated, fluid dispensing member to move from the second position, to the first position under the biasing force applied by the elongated biasing member.

15. A liquid dispensing lid as claimed in claim 14, and wherein the elastomeric engagement member having the drinking aperture sealing member, vent aperture sealing member, and the biasing member are easily removed from the elongated, fluid dispensing member so as to facilitate the cleansing of the liquid dispensing lid.

* * * * *